United States Patent [19]
Gzym et al.
[11] 4,449,337
[45] May 22, 1984

[54] ADJUSTABLE BASE FOR OFFICE LANDSCAPING SYSTEM

[75] Inventors: Larry P. Gzym, Rockford; Lloyd G. Ritzema, Lowell; David K. Haadsma, Jr., Wyoming, all of Mich.

[73] Assignee: Stow Davis Furniture Company, Grand Rapids, Mich.

[21] Appl. No.: 358,091

[22] Filed: Mar. 15, 1982

[51] Int. Cl.[3] ..... E04G 21/00
[52] U.S. Cl. ..... 52/126.4; 52/242
[58] Field of Search ..... 52/122, 126.4, 126.7, 52/241, 242, 243.1, 678, 698, 222, 290

[56] References Cited

U.S. PATENT DOCUMENTS

| | | | |
|---|---|---|---|
| 2,540,622 | 2/1951 | Langenberg | 72/77 |
| 2,877,875 | 3/1959 | Bolt | 189/34 |
| 3,111,723 | 11/1963 | Bates | 52/126.7 |
| 3,216,678 | 11/1965 | Foedisch | 248/1 |
| 3,386,216 | 6/1968 | Zwickert | 52/242 |
| 3,771,273 | 11/1973 | Brodie | 52/646 |
| 3,885,361 | 5/1975 | De Schutter | 52/122 |
| 3,899,857 | 8/1975 | Mochizuki | 52/678 |
| 3,979,864 | 9/1976 | Tillie | 52/122 |
| 4,056,903 | 11/1977 | Guarnere | 52/122 |
| 4,086,734 | 5/1978 | Hayashi | 52/126.4 |
| 4,103,463 | 8/1978 | Dixon | 52/126.4 |

FOREIGN PATENT DOCUMENTS

| | | | |
|---|---|---|---|
| 404164 | 6/1966 | Switzerland | 52/126.4 |

*Primary Examiner*—John E. Murtagh
*Assistant Examiner*—Andrew Joseph Rudy
*Attorney, Agent, or Firm*—Price, Heneveld, Huizenga & Cooper

[57] ABSTRACT

The specification discloses a wall panel base construction including a foot, a wall panel supporting assembly, and a plurality of oppositely threaded members extending between the foot and the supporting assembly. The lower portion of each threaded member is secured within a block, which is in turn pivotally supported on the foot to prevent the threaded members from jamming during height adjustment. The blocks are also laterally shiftable with respect to the foot to further accommodate movement of the threaded member during height adjustment.

23 Claims, 5 Drawing Figures

ADJUSTABLE BASE FOR OFFICE LANDSCAPING SYSTEM

BACKGROUND OF THE INVENTION

The present invention relates to a base construction for a wall panel assembly, and more specifically to a height-adjustable base construction.

Modular wall panel and furniture systems are used in a wide variety of applications because of their efficient and relatively inexpensive partitioning of a large open area into efficient office space. The modular constructions provide a relatively high concentration of work stations within a given area.

Due to the fact that the panel systems are often installed on floors which are not level, for example in old buildings, it is necessary that the panel systems include means for plumbing, or leveling, the panels above an out-of-level floor. One such system includes a foot, a wall panel supporting assembly, and threaded members extending between, and threaded within, the foot and the support assembly. Each of the threaded members is oppositely threaded in opposite directions at its opposite ends so that when the threaded member is rotated in a first direction, the foot is withdrawn into the support assembly; and when rotated in a second direction, the foot is extended from the support assembly. Consequently, the threaded members may be individually adjusted to level the support assembly and the panels supported thereon. An example of such a system is disclosed in U.S. Pat. No. 4,407,101, entitled BASE CONSTRUCTION FOR PANEL, issued Oct. 4, 1983, to the assignee of the present invention. However, the threaded members have a tendency to be inclined from the vertical and jam when one threaded member is adjusted to a height significantly different from another threaded member so that the panel and support assembly are at relatively steep angles with respect to one another. Consequently, the height-adjusting mechanism is frequently difficult to adjust and forcing such adjustment results in ruining the mechanism during installation. Thus, the panels cannot be plumbed, or leveled, above a seriously out-of-level floor because the threaded members cannot be adjusted to significantly different heights without jamming the threaded members.

Another adjustable base construction for wall panels as shown in U.S. Pat. No. 3,885,361, entitled BUILDING WALL PANEL LEVELER DEVICE, issued May 27, 1975, to DeSchutter, includes a leveler support track slidably supporting a leveler device which includes a lower support member slidable on the leveler support track and an upper support member on which a panel supporting member rests. A height adjusting means comprising a threaded bolt with a hexagonal head is located between the foot and the upper support member and is received by a threaded opening in the upper support member. Thus, rotating the bolt in one direction lifts the upper support member to lift the panel support, while rotating it in the opposite direction lowers the panel support. The bolt is pivotally supported on the lower support member by means of a ball-and-socket arrangement to permit the entire assembly to tilt toward or away from the opposite ends of the lower support member and/or the sliding of the lower support member on the leveler support track. Although we have not built and tested the ball-and-socket arrangement, we believe it is generally not sufficiently strong as is often necessary to support the relatively large weight of the panels and panel supporting assembly.

SUMMARY OF THE INVENTION

The aforementioned problems are solved by the present invention. Essentially, a wall panel base construction is provided comprising a foot, a wall panel support assembly, and a plurality of height adjustment assemblies extending between the foot and the panel support assembly. Each height adjustment assembly includes an elongated adjustable member having an upper end threaded in the support assembly and a lower end threaded within a block, which in turn is pivotally supported on the foot. Any of the elongated members can be adjusted to any height, and accordingly inclined from the vertical, without fear of jamming that, or any other, adjustment member because the block will pivot to accommodate the inclination of the adjusted member. The cited structure has improved strength over known ball-and-socket arrangements due to the fact that the lower end of the height adjustment member is secured within a block, which in turn is pivotally supported on the foot. Consequently, the reliability and adjustability of the present base construction is greatly improved over known constructions.

In a preferred embodiment of the invention, the block is also mounted for longitudinal movement with respect to the foot. In this embodiment, the block may shift longitudinally with respect to the foot during height adjustment to accommodate the shifting lower end of the adjustment member inclination. This further reduces wear and fatigue forces within the base construction, increasing the reliability of the wall panel system.

These and other objects, advantages, and features of the invention will be more readily understood and appreciated by reference to the written specification and appended drawings.

DESCRIPTION OF THE PREFERRED EMBODIMENT

Figure 1:
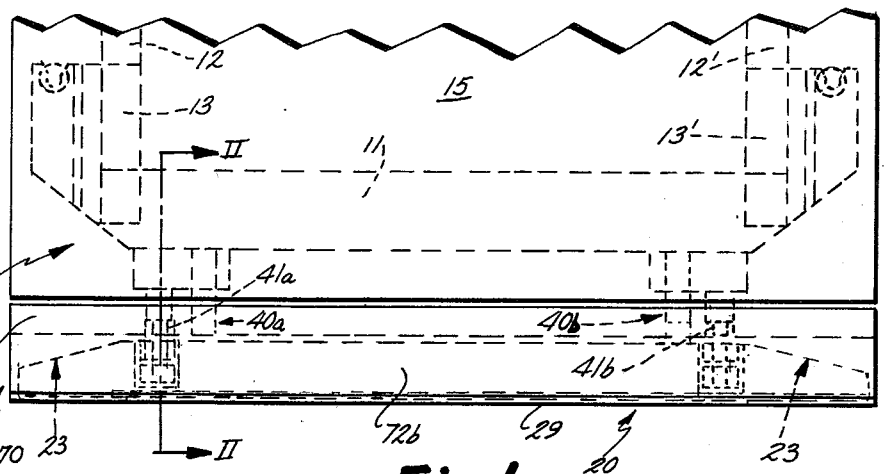
FIG. 1 is a fragmentary front plan view of the wall panel support base of the present invention with a support assembly and wall panel installed thereon.
Figure 5:
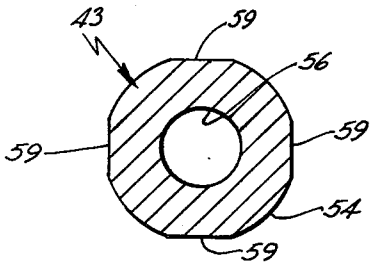
FIG. 5 is a sectional view taken along plane V—V in FIG. 3.

As disclosed in FIG. 1, the panel system of the present invention includes a wall panel support assembly 10, a foot assembly 20, an adjustment assembly 40 extending between the foot assembly and the panel support assembly, and an enclosure assembly 70 for hiding the adjustment assembly and for providing wire raceways. Adjustment assembly 40 (FIGS. 2, 3, and 4) includes a member 41 having oppositely threaded ends secured within socket 42 rigidly secured to support assembly 10 and block 43. Block 43 is pivotally supported on clip 44, which in turn is locked within, and supported on, foot assembly 20. When adjustment assembly **40*a* (FIG. 1) is adjusted to a significantly different height than adjustment assembly 40*b*, both of blocks 43*a* and 43*b* pivot within clips 44***a* and 44*b* to accommmodate the inclined threaded members 41*a* and 41*b*. Additionally, blocks 43 shift laterally within clips 44 to accommodate inclined members 41. Consequently, threaded members 41 do not jam within sockets 42 and blocks 43.

Turning more specifically to the construction of the wall panel base, it is seen that assembly 10 includes a horizontal lower member 11, generally rectangular in cross section; a vertical member 12, generally square in cross section; and a gusset 13 interconnecting the horizontal and vertical members. The construction of assembly 10 is more fully disclosed in copending application Ser. No. 358,277, filed on even date herewith, entitled WALL PANEL CONSTRUCTION SYSTEM, and assigned to the assignee of the present invention. As most clearly seen in FIG. 2, assembly 10 supports a pair of panels, or panel skins, 14 and 15 which are suspended on brackets 13 to closely overlie assembly 10 as described in the referenced application. Consequently, support assembly 10 with panels 14 and 15 mounted thereon forms a partition of an office landscaping system.

Foot assembly 20 (FIGS. 3 and 4) includes a channel member 21, generally U-shaped in cross section, including bottom wall 22 and integral sidewalls 23*a* and 23*b* extending upwardly therefrom. Feet 30 (FIG. 4) are secured to opposite ends of channel member 21. More particularly, feet 30 each include a downwardly inclined top wall 25 extending from and secured to sidewalls 23*a* and 23*b* by welding the portion 24 to the sidewalls. Top wall 25 inclines downwardly and outwardly from top wall 24 to end wall 26 which extends downwardly and generally perpendicular to the floor. Bottom wall 27 extends from sidewall 26 to channel member 21 and is secured to the underside of bottom wall 22 by welding. Threaded socket 31 is secured in foot 30 to optionally receive leveling feet. Generally U-shaped tab 28 (FIGS. 3 and 4) which, in conjunction with portion 24, provides a support for clip 44, is secured between sidewalls 23*a* and 23*b* of channel member 21 in an inverted position again by welding and is spaced from top wall 24 of foot 30. Foam cover 29 (FIGS. 3 and 4) is a dip molded, pocket-shaped member in which channel member 21 and feet 30 closely interfit. Preferably, foam cover 29 is black to provide contrast between foot assembly 20 and enclosure assembly 70.

Figure 4:
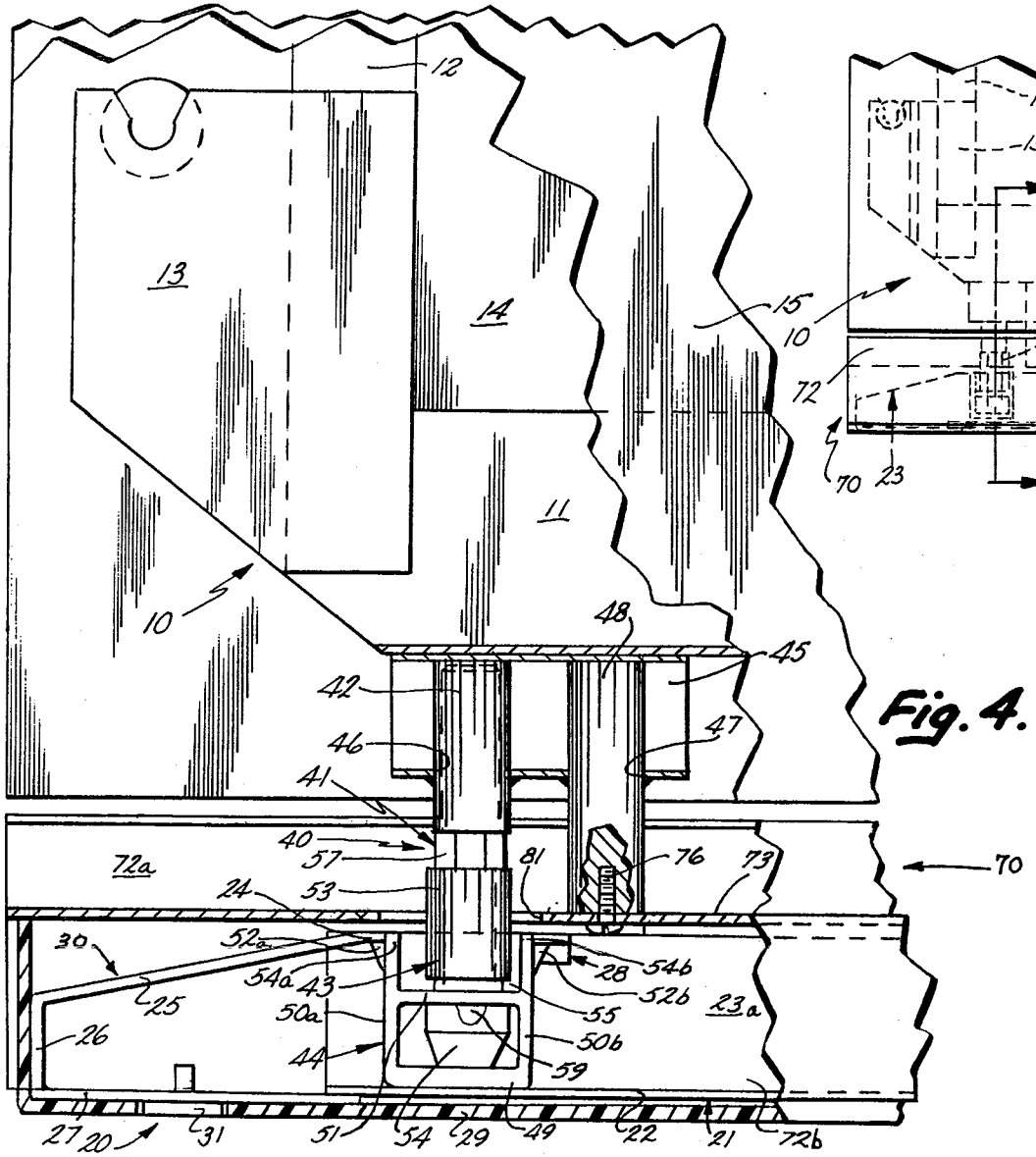
FIG. 4 is a sectional view taken along plane IV—IV in FIG. 2.
Figure 2:
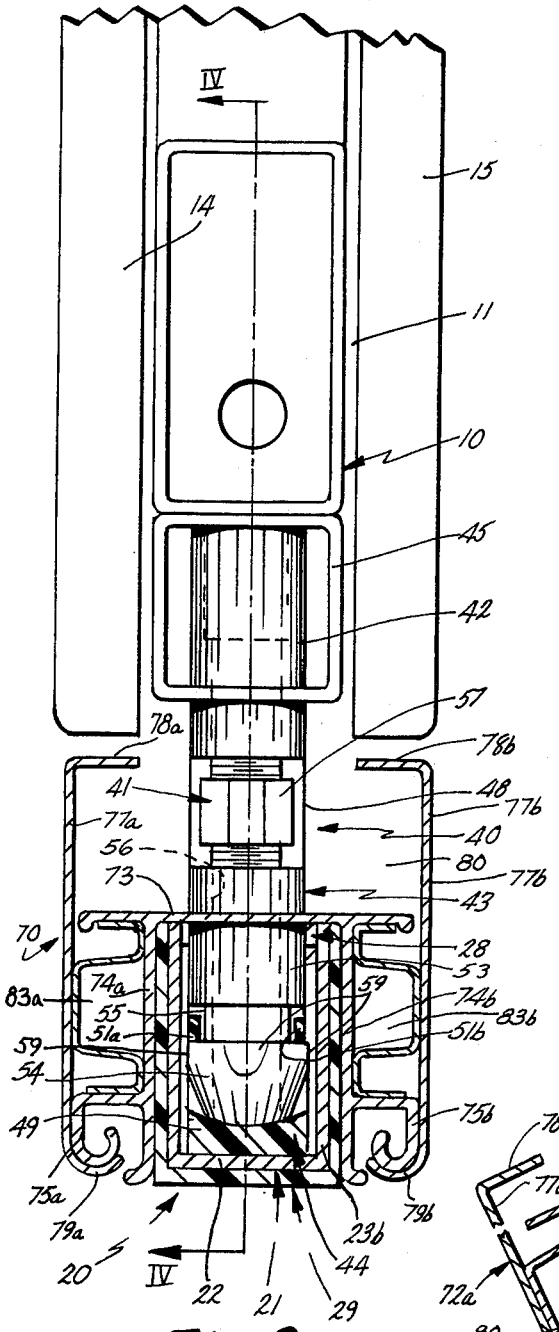
FIG. 2 is a sectional view taken along plane II—II in FIG. 1.
Figure 3:
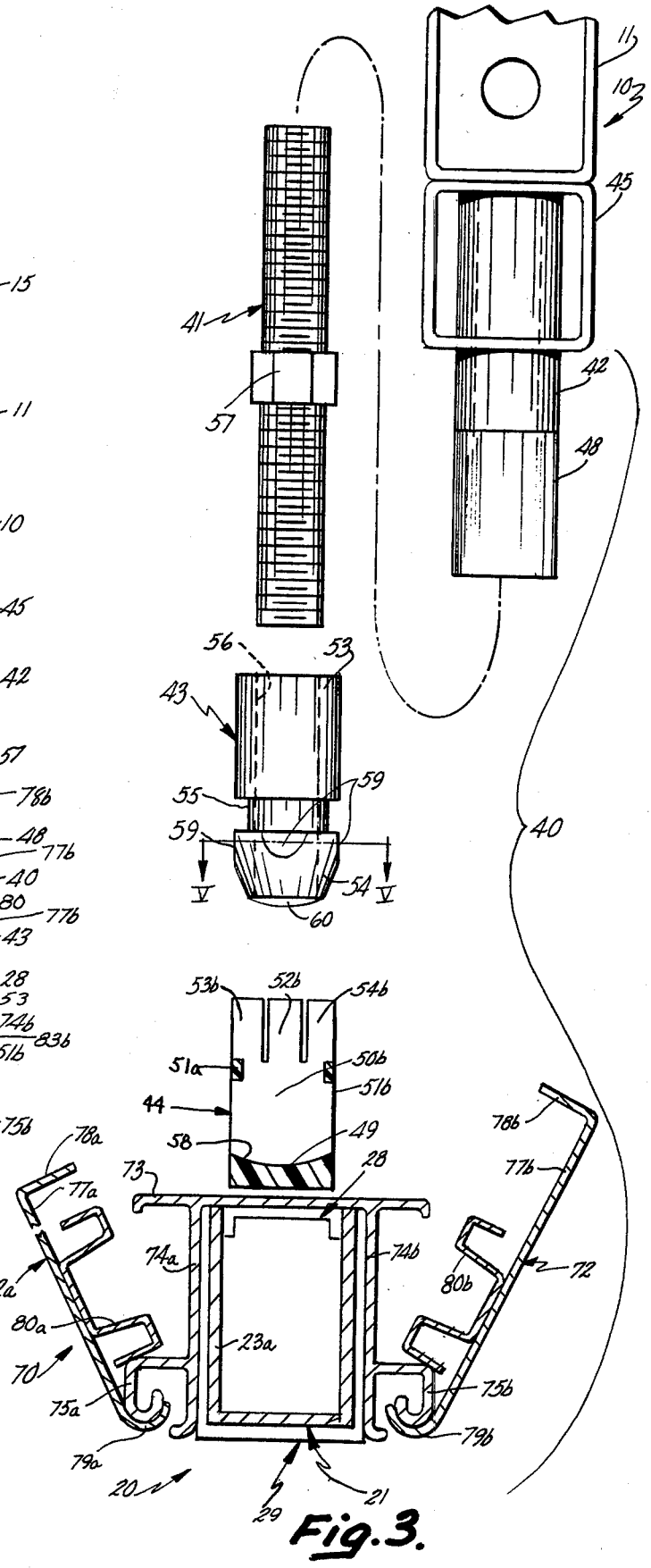
FIG. 3 is an exploded, sectional view of the support base alone as shown in FIG. 2.

As best seen in FIGS. 2, 3, and 4, adjustment assembly 40 generally includes threaded member 41 extending between socket 42 supported within tube 45 and block 43 supported on clip 44. Support tube 45 is generally square in cross section and secured to the underside of horizontal member 11 by welding. Support tube 45 defines insert aperture 46 and cylinder aperture 47 in its underside (see FIG. 4). Socket 42 extends through aperture 46 and is secured within tube 45 by welding. Socket 42 is a generally cylindrical, tubular member extending the full height of support tube 45 and extending a short distance below the tube. Additionally, socket 42 is internally threaded to receive the upper end of member 41. Support stud 48 is also a generally cylindrical body and extends through support stud aperture 47 into tube 45. Support stud 48 is somewhat longer than socket 42 and consequently extends downwardly below the socket. Studs 48 provide a means for suspending enclosure assembly 70 from support assembly 10.

Clip or socket 44 (FIGS. 2, 3, and 4) is a plastic member including bottom wall 49, a pair of generally parallel and planar sidewalls 50*a* and 50*b* extending upwardly therefrom, and a pair of spaced parallel ribs 51*a* and 51*b* extending between sidewalls 50. As most clearly seen in FIG. 3, bottom wall 49 defines a concave upper surface 58 upon which block 43 rests. Ribs 51*a* and 51*b* are generally parallel to one another and generally rectangular in cross section. Integral detents 52*a* and 52*b* extend slightly outwardly from sidewalls 50*a* and 50*b*, respectively, proximate positioning extensions 53 and 54. When properly seated within foot assembly 20, clip 44 is located with bottom wall 49 abutting bottom wall 22 of channel member 21, and with detents 52*a* and 52*b* immediately below top wall 24 of foot 30 and tab 28, respectively (see FIG. 2). Additionally, positioning extensions 53 and 54 of sidewalls 50*a* and 50*b* are located adjacent top and wall 24 and tab 28, respectively, to laterally maintain clip 44 in relation to foot assembly 20.

Block 43 (FIGS. 2, 3, and 4) rests on clip 44, and more particularly on upper surface 58 of bottom wall 49. Block 43 includes a generally rectangular upper portion 53, a tapered lower portion 54, and an annular groove, or channel 55 separating the two portions. Additionally, block 43 defines threaded bore 56 extending vertically through the member to receive the lower end of threaded member 41. Tapered portion 54 includes four flattened surfaces 59 equally spaced about block 43. Bottom 60 of tapered portion 54 is slightly convex to interfit with upper surface 58 of clip 44 (see FIG. 2). Annular groove 55 is substantially wider than ribs 51 so that the groove is dimensioned to loosely receive ribs 51*a* and *b*, positioned on opposite sides of block 43 is assembled assembly 40. Consequently, block 43 is free to shift longitudinally within clip 44 by means of the grooves 55 receivinfg ribs 51*a* and 51*b* lengthwise of foot assembly 20. Additionally, block 43 is free to pivot with respect to clip 44; more particularly, bottom 60 of lower portion 50 pivots on upper surface 58 of bottom wall 49, and block 43 shifts with respect to ribs 51.

Threaded member 41 includes a hex portion 57 separating two oppositely threaded ends. Threaded member 41 is secured within and between socket 42 and block 43 such that when the member is rotated in a first direction, the socket and block are drawn together, and when rotated in a second direction, the socket and block are forced apart. Consequently, the height of support assembly 10 above foot assembly 20 may be adjusted to level, or plumb, wall panels 14 and 15 by appropriately adjusting assemblies 40.

Enclosure assembly 70 is supported on studs 48 to slidingly engage foot assembly 20. Assembly 70 includes sealing member 71 and covers 72*a* and 72*b* pivotally mounted thereto. Sealing member 71 is a plastic extrusion and includes generally horizontal top wall 73 and sidewalls 74*a* and *b* depending downwardly therefrom to closely receive foot assembly 20 and more specifically foam cover 29. Top wall 73 extends outwardly beyond sidewalls 74 (FIGS. 2 and 3) and defines an aperture 81 (FIG. 4) through which socket 42 extends. Hinge flanges 75*a* and 75*b* extend laterally outwardly from sidewalls 74*a* and 74*b*, respectively to provide a support for covers 72. Sealing member 71 is secured to support studs 48 by passing screws 76 through top wall 73 and into the support stud as shown in FIG. 4. Consequently, sealing member 71 is maintained in fixed relationship to support assembly 10. Therefore, as threaded member 41 is rotated, sealing member 71 travels with support assembly 10 to slide along foot assembly 20 positioned between sidewalls 74.

Covers 72 extend generally the full length of sealing member 71 and include a generally planar body portion 77 having an exterior chrome finish to contrast with foam cover 29. Each of covers 72 terminates at its upper edge in inwardly extending flange 78 and at its lower edge in inwardly curved flange 79. Flanges 79 cooperate with hinge hook flanges 75 to pivotally support covers 72 on sealing member 71. W-shaped spring clips 80*a* and *b* are secured to the inside of body portions 77*a* and 77*b*, respectively, to secure covers 72 in the closed position (FIG. 2), wherein springs 80 are compressibly secured between top wall 73 and hinge flanges 75. A plurality of wire raceways are defined between covers 72*a* and *b*, most notably raceway 82 above sealing member 71 and raceway 83*a* and *b* between spring clips 80 and sidewalls 74.

Assembly and Operation

The wall panel system is assembled by first attaching sealing member 71 to studs 48 extending from support assembly 10. Blocks 43 are then inserted into clips 44 by flexing ribs 51 outwardly away from one another and inserting tapered portion 54 between the ribs. Alternatively tapered portion 54 can be forced between ribs 51, which forces the ribs apart. When bottom 60 of block 43 engages bottom wall 49 of clip 44, ribs 51 snap inwardly into groove 55. This block and clip assembly is then snap-fitted into foot assembly 20 by inserting clip 44 between foot 30 and tab 28 until detents 52 lock underneath top wall 24 and tab 28, respectively. When so installed, block 43 cannot be removed from clip 44 unless the clip is removed from foot assembly 20. Threaded member 41 is then threaded into both socket 42 and block 43. Finally, covers 72 are mounted on sealing member 71, and the support structure is ready for shipment with panels 14 and 15. At the installation site, support assemblies 10 are interconnected as disclosed in the referenced application and panels 14 and 15 are suspended thereon.

The wall panel base construction of the present invention facilitates the leveling of support assembly 10 above foot assembly 20. After the wall panel assembly has been erected, threaded members 41*a* and 41*b* are then rotated appropriately to level the support assembly 10 above foot assembly 20. If one of adjusting assemblies 40 is adjusted to a height different from that of the other adjusting assembly, both of the threaded members 41 will incline from the vertical. As assemblies 40 are inclined out of the vertical, block 43 pivots within clip 44 to accommodate the inclination. As block 43 pivots, bottom 60 of the block pivots on bottom wall 49 of clap 44; the play between ribs 51 and groove 55 permits the block to pivot with respect to the ribs. Additionally, because the upper end of member 41 is laterally fixed within socket 42, the bottom end of member 41 shifts longitudinally forcing block 43 to shift within clip 44 as groove 55 travels along ribs 51. Consequently, the bock and clip cooperate to fully accommodate both the pivotal and lateral movement required during panel leveling.

Wiring may be installed within enclosure assembly 70 by pivoting covers 72 to their open position as indicated in FIG. 3. The wires are then placed between covers 72 and either sealing member 71 or adjustment assemblies 40, and covers 72 are then returned to their closed position as indicated in FIG. 2. The installed wires are securely maintained in position behind covers 72. Of course, the wires may be subsequently modified or removed altogether by reopening covers 72 and modifying the wiring configuration.

It should be understood that the above description is intended to be that of a preferred embodiment of the invention. Various alterations and modifications can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A wall panel base construction comprising:
means for supporting a wall panel;
foot means for supporting said base construction on a surface;
a block member defining a threaded bore;
means for supporting said block member within said foot means for tilting and shifting movement with respect to said foot means; and
an upwardly extending threaded member having a lower threaded portion adjustably secured within said threaded bore within said block member, said threaded member having an upper portion supporting said wall panel support means, said threaded member thereby operatively supporting said panel support means on said foot means, whereby the height of said panel supporting means above said foot means can be adjusted by rotating said threaded member, and whereby said block member tilts and shifts to accommodate tilting and shifting of said threaded member with respect to said foot means to prevent said threaded member from jamming within said block member.

2. A wall panel base construction as defined in claim 1 wherein said block member includes external groove means and said block member support means includes rib means for extending into said groove means.

3. A wall panel base construction as defined in claim 2 wherein said block member supporting means comprises a socket snap-fitted within said foot means.

4. A wall panel base construction as defined in claim 3 wherein said rib means comprises a pair of spaced ribs positioned on opposite sides of said block member.

5. A wall panel base construction as defined in claim 4 wherein said spaced ribs are generally parallel to one another.

6. A wall panel base construction as defined in claim 3 wherein said socket comprises a plastic material.

7. A wall panel base construction as defined in claim 2 wherein aid groove means comprises an annular groove.

8. A wall panel base construction as defined in claim 2 wherein said upper portion is threaded in a direction opposite to said lower threaded portion; and wherein said upper threaded portion is secured within said wall panel supporting means.

9. A wall panel base construction as defined in claim 8 wherein said wall panel support means comprises a threaded socket in which said upper threaded portion is secured.

10. A wall panel base construction as defined in claim 8 wherein said threaded member comprises means mediate said lower and upper threaded portions for grasping said threaded member to rotate said threaded member.

11. A wall panel base construction comprising:

panel support means for supporting a wall panel;

foot means for supporting said base construction on a surface;

block means for defining a bore;

block support means for supporting said block means on said foot means for tilting movement with respect to said foot means; and third support means for operatively supporting said panel support means on said foot means, said third support means including height adjusting means for adjusting the height of said wall panel support means above said foot means, said height adjusting means having a first portion supported within said block means and a second portion supporting said panel support means, whereby said block tilts with said height adjusting means with respect to said foot means during height adjustment.

12. A wall panel base construction as defined in claim 11 wherein said block support means is further for supporting said block for lateral movement with respect to said foot means.

13. A wall panel base construction as defined in claim 12 wherein said block support means comprises a socket supported within said foot means.

14. A wall panel base construction as defined in claim 13 wherein said socket comprises a pair of spaced ribs; and wherein said block means defines groove means for interfitting with said ribs.

15. A wall panel base construction as defined in claim 14 wherein said ribs are generally parallel to one another.

16. A wall panel base construction as defined in claim 14 wherein said groove means comprises said block means defining an annular groove.

17. A wall panel base construction as defined in claim 13 wherein said socket is snap-fitted into said foot means.

18. A wall panel base construction as defined in claim 17 wherein said socket comprises a plastic material.

19. A wall panel base construction as defined in claim 11 wherein said bore in said block means is threaded; and wherein said first portion of said height-adjusting means is threaded and positioned within said bore.

20. A wall panel base construction as defined in claim 19 wherein said second portion of said height-adjusting means is threaded in a direction opposite said first portion and secured within said wall panel support means.

21. A wall panel base construction as defined in claim 20 wherein said wall panel support means comprises a threaded socket in which said second portion of said height-adjusting means is secured.

22. A wall panel base construction as defined in claim 20 wherein said height adjusting means further comprises means between said first and second threaded portions for grasping said height-adjusting means.

23. A wall panel base construction as defined in claim 22 wherein said grasping means comprises a hex portion.

* * * * *

UNITED STATES PATENT AND TRADEMARK OFFICE

CERTIFICATE OF CORRECTION

PATENT NO. : 4,449,337

DATED : May 22, 1984

INVENTOR(S) : Larry P. Gzym et al

It is certified that error appears in the above-identified patent and that said Letters Patent is hereby corrected as shown below:

Column 4, line 15:
after "top" delete "and";

Column 4, line 31:
"is" should be --in--;

Column 4, line 34:
"receivinfg" should be --receiving--;

Column 5, line 51:
"clap" should be --clip--; and

Column 6, claim 7, line 52:
"aid" should be --said--.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*